US010615540B2

(12) United States Patent
Hou et al.

(10) Patent No.: US 10,615,540 B2
(45) Date of Patent: Apr. 7, 2020

(54) ELECTRICAL PLUG CONNECTOR

(71) Applicant: ADVANCED-CONNECTEK INC., New Taipei (TW)

(72) Inventors: Pin-Yuan Hou, New Taipei (TW); Shuang-Xi Xiao, New Taipei (TW); Yu-Chai Yeh, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 16/243,812

(22) Filed: Jan. 9, 2019

(65) Prior Publication Data

US 2019/0214767 A1 Jul. 11, 2019

(30) Foreign Application Priority Data

Jan. 10, 2018 (CN) ..... 2018 2 0038374 U

(51) Int. Cl.
*H01R 13/627* (2006.01)
*H01R 13/405* (2006.01)
*H01R 13/506* (2006.01)

(52) U.S. Cl.
CPC ..... *H01R 13/6273* (2013.01); *H01R 13/405* (2013.01); *H01R 13/506* (2013.01); *H01R 13/6275* (2013.01)

(58) Field of Classification Search
CPC ..... H01R 13/6275; H01R 23/7005; H01R 13/65802; H01R 13/4536; H01R 23/682; H01R 13/6271; H01R 23/7063
USPC ..... 439/358, 327, 353, 357, 350, 939, 138, 439/567, 326, 562, 570
See application file for complete search history.

(56) References Cited

U.S. PATENT DOCUMENTS 5,971,790 A * 10/1999 Rohde ..... H01R 13/627 439/350
7,628,636 B2 * 12/2009 Yu ..... H01R 13/6275 439/352

* cited by examiner

*Primary Examiner* — Phuong Chi Thi Nguyen
(74) *Attorney, Agent, or Firm* — Muncy, Geissler, Olds & Lowe, P.C.

(57) ABSTRACT

An electrical plug connector includes an insulated housing, contact terminals held in the insulated housing, an outer shell covering the insulated housing, and hook members. First buckle structures are at side arms at two sides of the insulated housing. Each of the hook members includes a second buckle structure mating with the corresponding first buckle structure. The buckle structures are of crescent shapes and mated with each other. When the press portion of the hook member is pressed by an excessive force, the first/second buckle structure stops the second/first buckle structure to prevent the elastic arm of the hook member from deforming. When the elastic arm is bounced back excessively, the first/second buckle structure stops the second/first buckle structure to prevent the hook member from detaching off the side arm.

11 Claims, 8 Drawing Sheets

ELECTRICAL PLUG CONNECTOR

CROSS-REFERENCE TO RELATED APPLICATION

This non-provisional application claims priority under 35 U.S.C. § 119(a) to Patent Application No. 201820038374.6 filed in China, P.R.C. on Jan. 10, 2018, the entire contents of which are hereby incorporated by reference.

FIELD OF THE INVENTION

The instant disclosure relates to an electrical connector, and more particular to an electrical plug connector.

BACKGROUND

Flexible flat cable (FFC) has advantages of high flexibility and good performance in signal transmission and is widely utilized in different electronic products. The characteristics of the flexible flat cable allow the space inside the electronic product to be utilized in a flexible manner. By inserting an end portion of the flexible flat cable into an electrical plug connector, the electrical plug connector at one location in the electronic product can be mated with an electrical receptacle connector at another location in the electronic product.

An electrical plug connector known to the inventor includes a plastic plate, a plurality of contact terminal on the plastic plate, and a shielding shell covering the plastic plate. Arm portions are extending from two sides of the plastic plate, and the contact terminals are in contact with contact points at a front end of a flat cable. Therefore, when the electrical plug connector is mated with an electrical receptacle connector, the contact terminals are in contact with terminals of the electrical receptacle connector, so that the electrical plug connector is electrically connected to the electrical receptacle connector. To ensure the connection between the electrical plug connector and the electrical receptacle connector, hooks at two sides of the electrical plug connector are utilized to buckle with the grooves at two sides of the electrical receptacle connector. When the electrical plug connector is to be detached from the electrical receptacle connector, the hooks are pressed to release the electrical receptacle connector.

SUMMARY OF THE INVENTION

However, the electrical plug connector known to the inventor does not have a stopping structure on the hook. As a result, when one of the hooks is pressed, the hook may squeeze with the structure in the plastic plate easily and the elastic portion of the hook may be deformed. Hence, the resilience performance of the hook is worsened.

In view of this, an embodiment of the instant disclosure provides an electrical plug connector. The electrical plug connector comprises an insulated housing, a plurality of contact terminals, an outer shell, and a plurality of hook members. An insertion part is extending outwardly from a front surface of the insulated housing and has a plurality of terminal grooves formed on an upper surface of the insertion part, and a cable fixing part is extending from a rear surface of the insulated housing. Two side arms are at two sides of the insulated housing. A recessed groove is formed sunken from a top surface of each of the side arms and a first buckle structure is formed on the top surface. The first buckle structure comprises a first curve portion and two first abutting portions at two ends of the first curve portion. The contact terminals are held in the insulated housing. Each of the contact terminals comprises a contact portion received and exposed in each of the terminal grooves of the insertion part and a tail portion received in the cable fixing part. The outer shell covers the insulated housing. The hook members are at the recessed grooves. Each of the hook members comprises a second buckle structure mating with the corresponding first buckle structure. A hook portion is extending from one of two ends of the second buckle structure toward a side portion of the insertion part, and a press portion is extending from the other end of the second buckle structure toward a side portion of the cable fixing part. The second buckle structure comprises a second curve portion and two second abutting portions at two ends of the second curve portion.

In one or some embodiments, the first buckle structure is protruded form from the top surface.

In one or some embodiments, each of the hook members comprises a shaft body, the shaft body comprises the second curve portion and the second abutting portions forming a hole, and the first curve portion is mated with the second curve portion and protruding out of the second curve portion.

In one or some embodiments, a total arc length of the first buckle structure is less than a total arc length of the second buckle structure.

In one or some embodiments, the first buckle structure is a hole opened on the top surface.

In one or some embodiments, each of the hook members comprises a shaft body, the second curve portion and the second abutting portions are protruding outwardly from a bottom portion of the shaft body.

In one or some embodiments, a total arc length of the first buckle structure is greater than a total arc length of the second buckle structure.

In one or some embodiments, each of the press portions comprises a side plate extending out of the corresponding side arm.

In one or some embodiments, each of the side plates comprises an elastic arm extending toward the corresponding recessed groove and contacting an inner surface of the corresponding recessed groove.

In one or some embodiments, a plurality of inspection holes is on a surface of the outer shell, and each of the inspection holes correspond to the corresponding first buckle structure and the corresponding second buckle structure.

In one or some embodiments, the first buckle structure comprises a first shaft portion at an inner side of the first curve portion, the second buckle structure comprises a second shaft at an inner side of the second curve portion, and first shaft portion is connected to the second shaft portion.

As above, according to one or some embodiments of the instant disclosure, the first buckle structure and the second buckle structure are of crescent shapes and mated with each other, and the first and second buckle structure are rotatable relative with each other. When the press portion is pressed by an excessive force, the first/second buckle structure stops the second/first buckle structure to prevent the elastic arm from deforming; on the other hand, when the elastic arm is bounced back excessively, the first/second buckle structure stops the second/first buckle structure to prevent the hook member from detaching off the recessed groove. Furthermore, the first buckle structure and the second buckle structure are of crescent shapes, so that the assembly and the disassembly for the side arm and the hook member can be achieved in a convenient manner.

Furthermore, the mating between the electrical plug connector and the electrical receptacle connector is achieved by an engagement manner, so that the electrical receptacle connector does not detach from the electrical plug connector in an unintentional manner.

Moreover, inspection holes are on the surface of the outer shell, and each of the inspection holes correspond to the corresponding first buckle structure and the corresponding second buckle structure. Therefore, an operator can check the first buckle structures and the second buckle structures from the inspection holes.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

Figure 1:
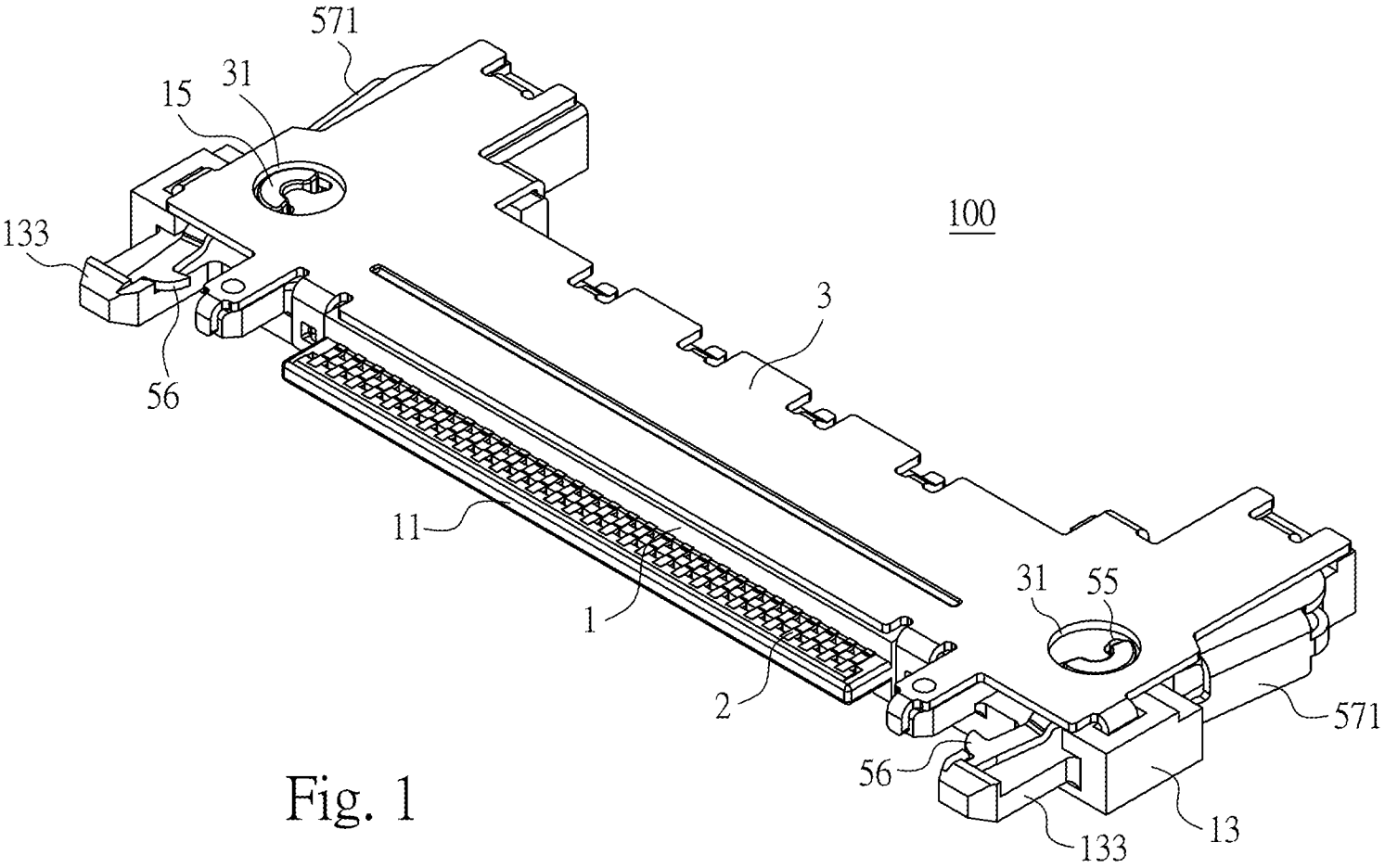
FIG. 1 illustrates a perspective view of an electrical plug connector according to a first embodiment of the instant disclosure.
Figure 2:
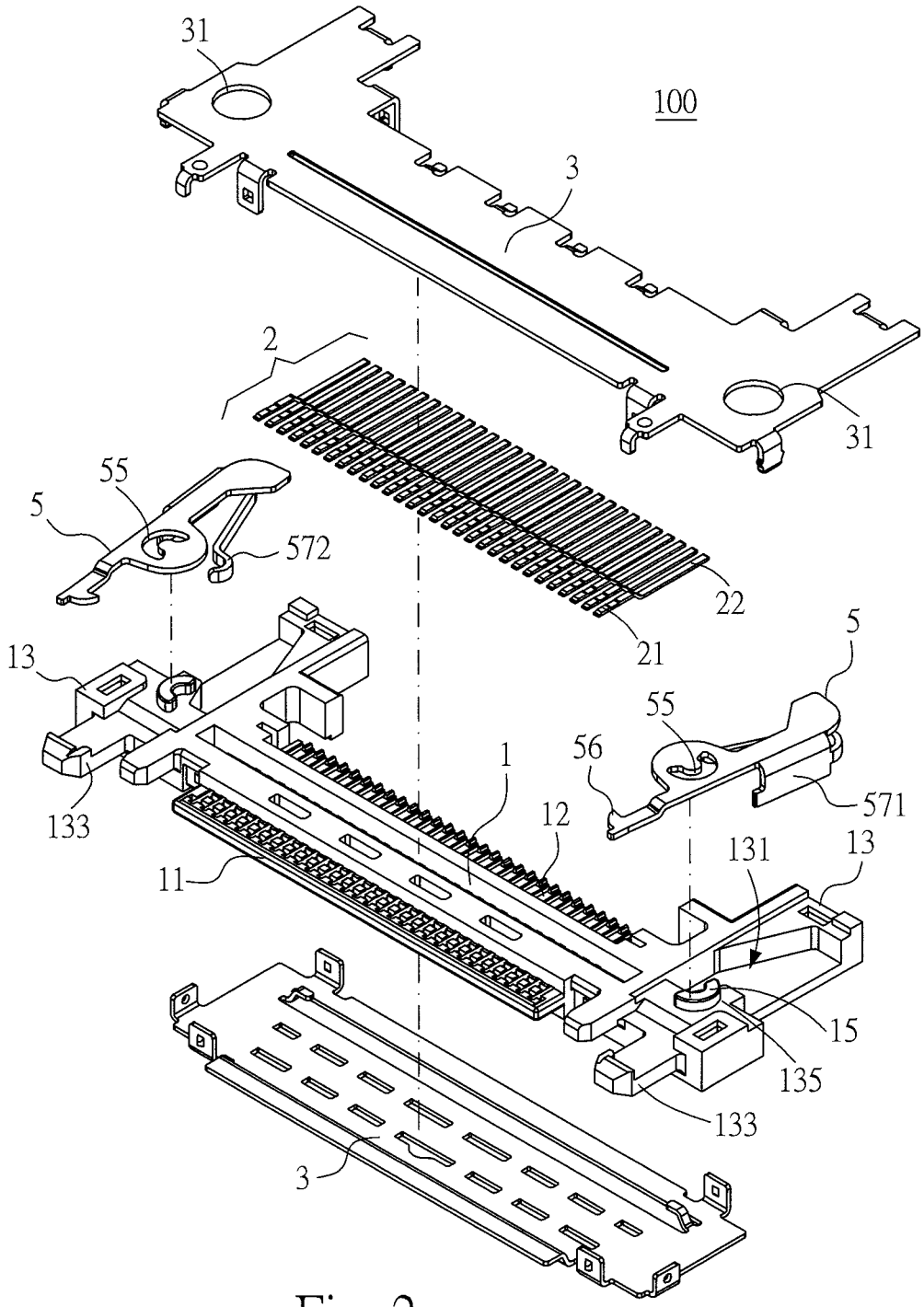
FIG. 2 illustrates an exploded view of the electrical plug connector of the first embodiment.
Figure 3:
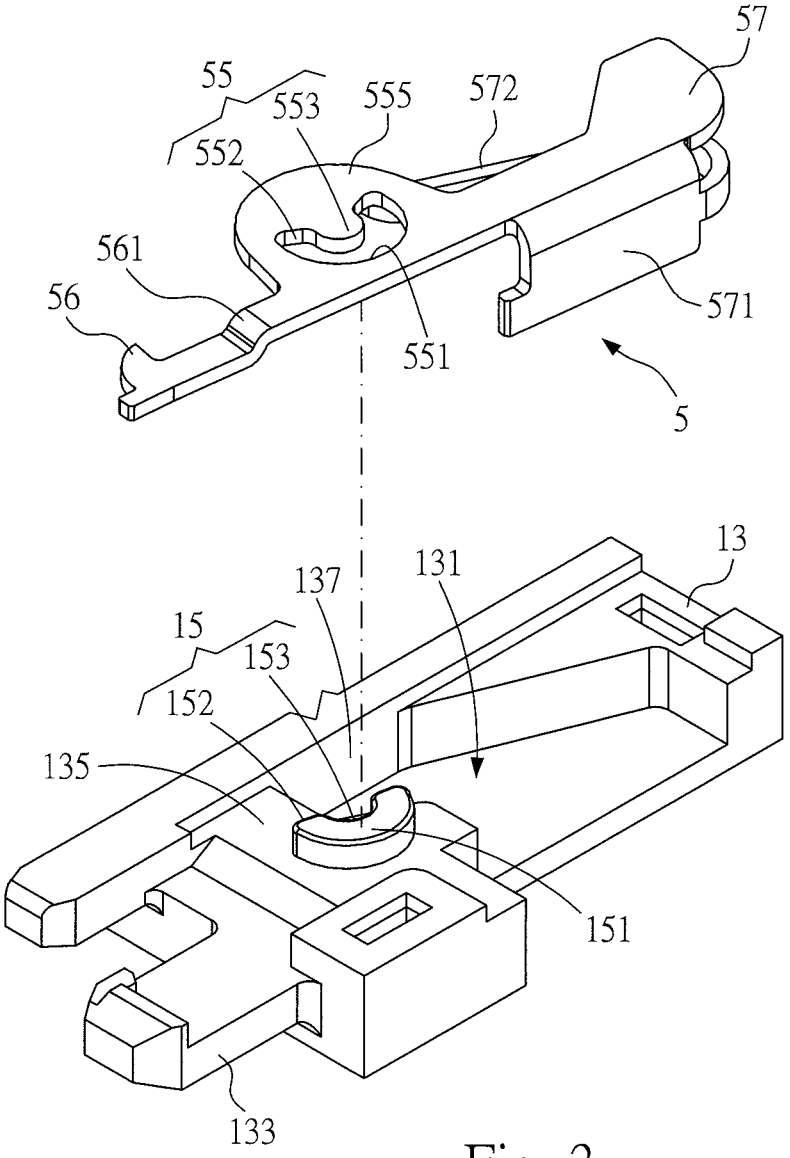
FIG. 3 illustrates a partial exploded view of the electrical plug connector of the first embodiment.

Please refer to FIGS. 1 to 3, illustrating an electrical plug connector 100 according to a first embodiment of the instant disclosure. FIG. 1 illustrates a perspective view thereof, FIG. 2 illustrates an exploded view thereof, and FIG. 3 illustrates a partial exploded view thereof. In this embodiment, the electrical plug connector 100 is provided with a flexible flat cable (FFC) (not shown). In this embodiment, the electrical plug connector 100 comprises an insulated housing 1, a plurality of contact terminals 2, an outer shell 3, and a plurality of hook members 5.

Figure 8:
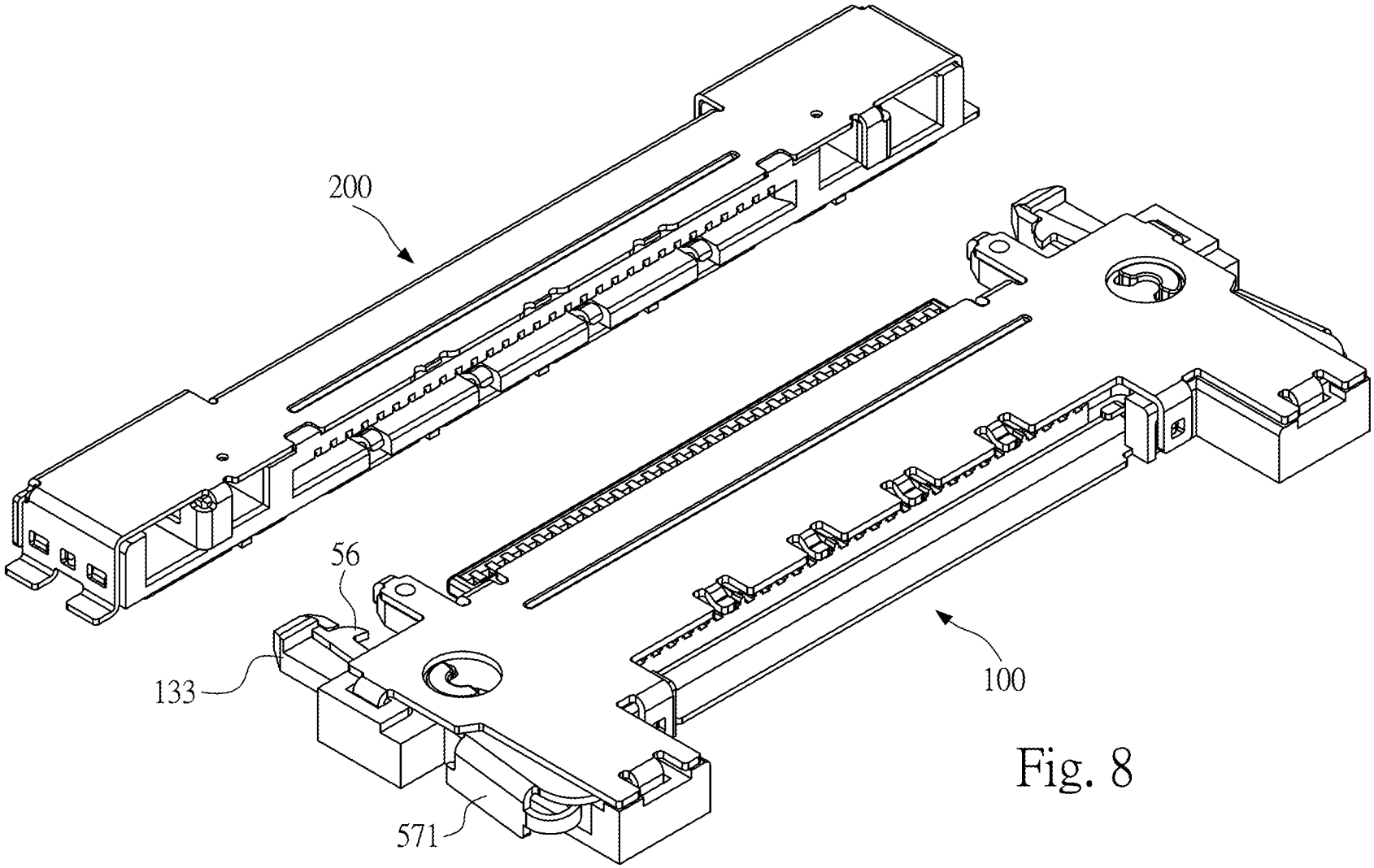
FIG. 8 illustrates an exploded view of an assembly of the electrical plug connector of the first embodiment and an electrical receptacle connector.

Please refer to FIGS. 1 to 3. In this embodiment, the insulated housing 1 is an elongated plate. An insertion part 11 is a plate-shaped part that extends from the front surface of a body of the insulated housing 1 and has a plurality of terminal grooves formed on its upper surface, and the insertion part 11 is adapted to be inserted into an insertion opening of an electrical receptacle connector 200 (as shown in FIG. 8). A cable fixing part 12 extends from the rear surface of the body of the insulated housing 1, and the cable fixing part 12 is adapted to be connected to a core lead of each conductive wire of the flexible flat cable disposed on the cable fixing part 12 from behind.

Please refer to FIGS. 1 to 3. In this embodiment, two side arms 13 are at two sides of the body of the insulated housing 1, and each side has one side arm 13. The insulated housing 1 and the two side arms 13 form an upside down U-shaped structure. A recessed groove 131 is formed sunken from a top surface 135 of each of the side arms 13, and a first buckle structure 15 is protruded from the top surface 135 of the side arm 13.

Please refer to FIGS. 1 to 3. In this embodiment, the first buckle structure 15 is extending outwardly (upwardly) from the top surface 135 to form a first curve portion 151 and two first abutting portions 152. Namely, the first buckle structure 15 forms a protruding block. In this embodiment, the first buckle structure 15 forms a crescent-shaped structure (or called C-shaped structure). The first buckle structure 15 comprises the first curve portion 151, the two first abutting portions 152 at two ends of the first curve portion 151, and a first shaft portion 153 at an inner side of the first curve portion 151. The first shaft portion 153 is a recessed portion. From a top view of the first buckle structure 15, the arc length of the first buckle structure 15 is equal to the perimeter of a half circle, but embodiments are not limited thereto. In some embodiments, the arc length of the first buckle structure 15 may be greater than or less than the perimeter of a half circle.

Please refer to FIGS. 1 and 2. In this embodiment, the contact terminals 2 are held in the insulated housing 1. Each of the contact terminals 2 comprises a contact portion 21 received and exposed in each of the terminal grooves of the insertion part 11 and a tail portion 22 received in the cable fixing part 12. The contact terminals 2 are arranged widthwise in the electrical plug connector 100 at a predetermined pitch.

Figure 5:
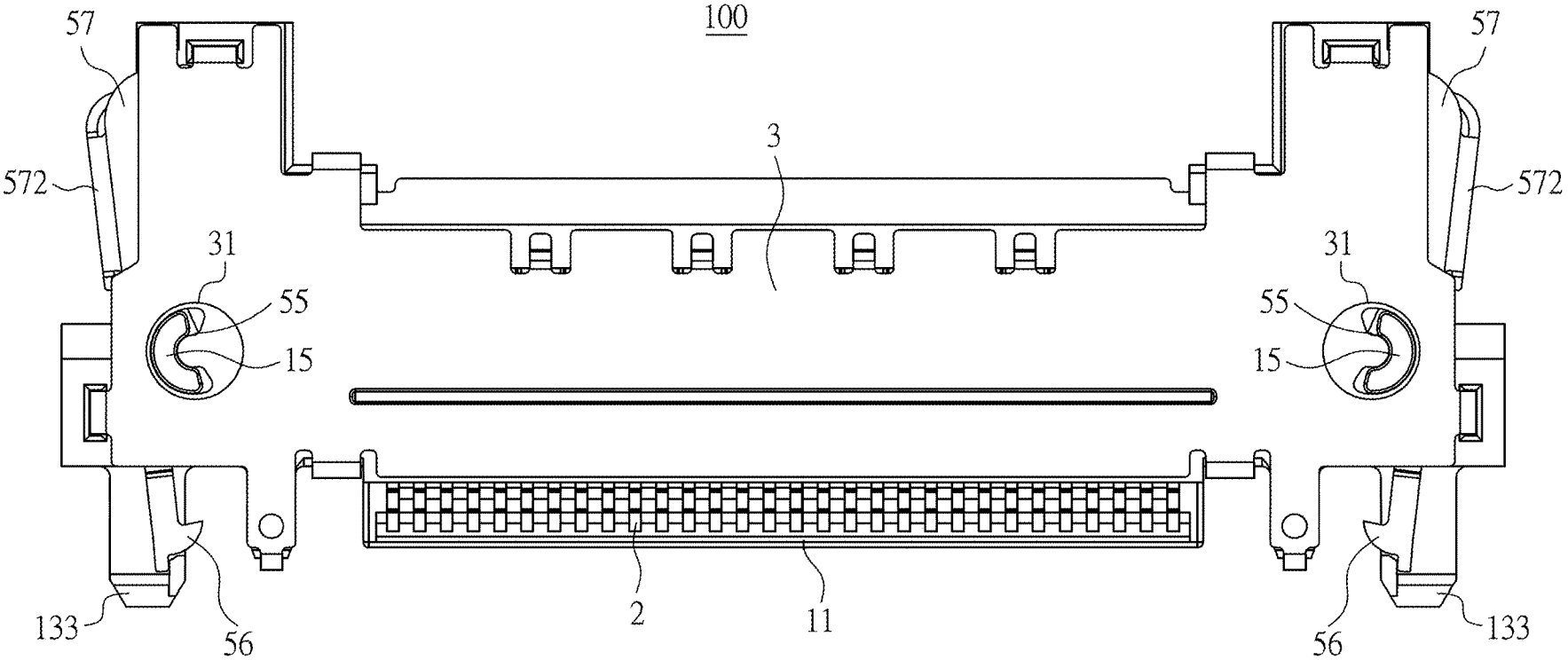
FIG. 5 illustrates a top view of the electrical plug connector of the first embodiment.

Please refer to FIGS. 1, 2, and 5. FIG. 5 illustrates a top view of the electrical plug connector of the first embodiment. In this embodiment, the outer shell 3 encloses the top portion and the bottom portion of the insulated housing 1. In this embodiment, inspection holes 31 are on a surface of the outer shell 3, and each of the inspection holes 31 correspond to the corresponding first buckle structure 15 and the corresponding second buckle structure 55. Therefore, an operator can check the first buckle structures 15 and the second buckle structures 55 from the inspection holes 31.

Figure 6:
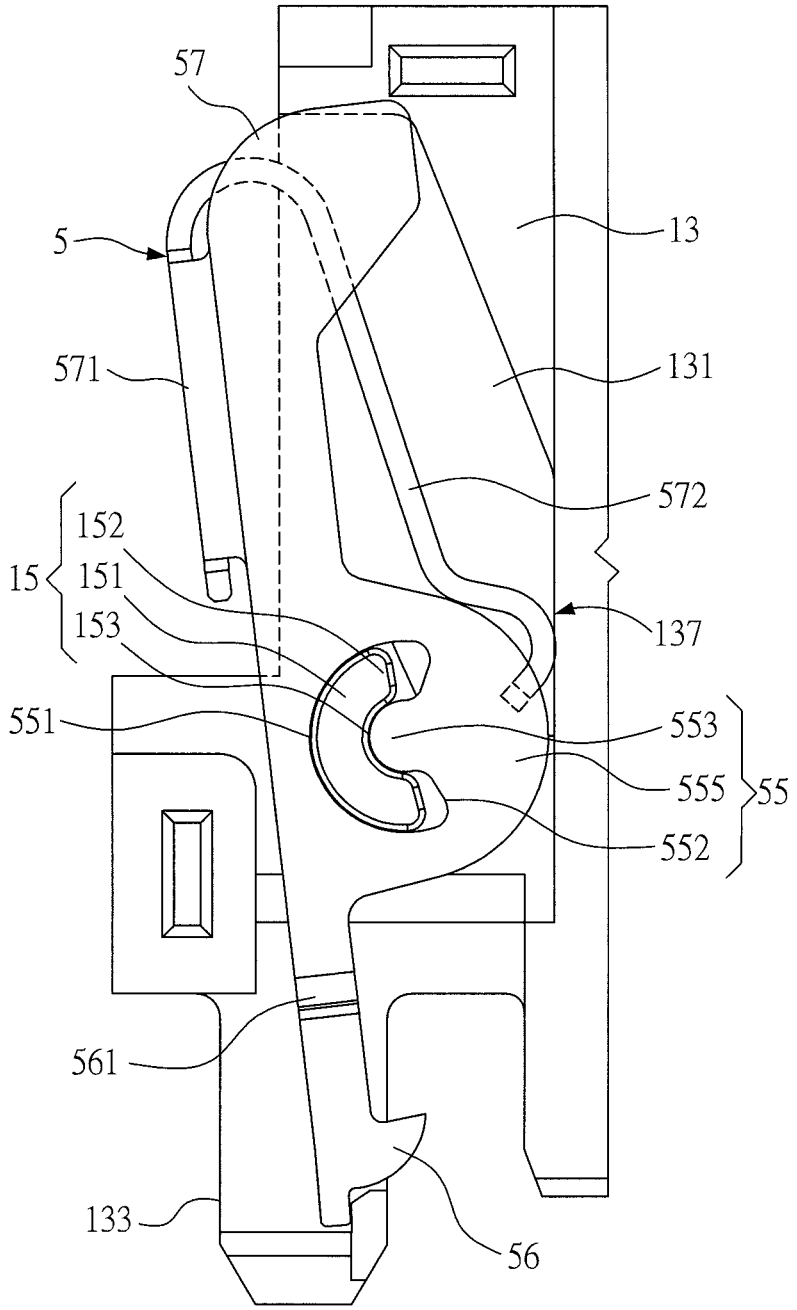
FIG. 6 illustrates a partial top view (1) of the electrical plug connector of the first embodiment.

Please refer to FIGS. 1, 2, 3, and 6. FIG. 6 illustrates a partial top view (1) of the electrical plug connector of the first embodiment. In this embodiment, the hook members 5 are formed by blanking techniques so as to have a better structural strength. Each of the hook members 5 is respectively at the corresponding recessed groove 131. Each of the hook members 5 comprises a second buckle structure 55 mating with the corresponding first buckle structure 15, a hook portion 56 extending from one of two ends of the second buckle structure 55 toward a side portion of the insertion part 11, and a press portion 57 extending from the other end of the second buckle structure 55 toward a side portion of the cable fixing part 12. In this embodiment, each of the press portions 57 comprises a side plate 571 extending out of the corresponding side arm 13. Moreover, each of the side plates 571 comprises an elastic arm 572 extending toward the corresponding recessed groove 131 and contacting the inner surface 137 of the corresponding recessed groove 131. The elastic arms 572 are formed by bending, so that the elastic arms 572 have proper elasticity as well as high structural strength, and the elastic arms 572 are also prone to be pressed.

Please refer to FIGS. 1, 2, 3, and 6. In this embodiment, each of the hook members 5 comprises a shaft body 555. The shaft body 555 comprises a second curve portion 551 and two second abutting portions 552 together forming a hole. Namely, the second buckle structure 55 is a through hole. In this embodiment, the second buckle structure 55 forms a crescent-shaped hole (or called C-shaped hole). The second buckle structure 55 comprises the second curve portion 551, the two abutting portions 552 at two ends of the second curve portion 551, and a second shaft portion 553 at an inner side of the second curve portion 551. The second shaft portion 553 is a protruding portion. The second shaft portion 553 is engaged with the first shaft portion 153 and rotated along the periphery of the first shaft portion 153. From a top view of the second buckle structure 55, the arc length of the second buckle structure 55 is greater than the perimeter of a half circle, but embodiments are not limited thereto. In some embodiments, the arc length of the second buckle structure 55 may be equal to or less than the perimeter of a half circle.

Please refer to FIGS. 1, 2, 3, and 6. In this embodiment, a width of the through hole of the second buckle structure is greater than or equal to a width of the protruding block of the first buckle structure. Therefore, the first buckle structure can be firmly assembled in the second buckle structure, and the first buckle structure can be moved in the second buckle structure for a short distance along a left-right (lateral) direction.

Please refer to FIG. 1. In this embodiment, the first curve portion 151 is mated with the second curve portion 551, the first curve portion 151 is protruding out of the second curve portion 551, and the protruding part of the first curve portion 151 is in the inspection 31 hole, but embodiments are not limited thereto. In some embodiments, the first curve portion 151 does not protrude out of the second curve portion 551, and the inspection hole 31 can be omitted. In other words, since the first curve portion 151 does not protrude out of the second curve portion 551 to abut against the outer shell 3, a through hole (i.e., the inspection hole 31) is not provided on a corresponding position of the outer shell 3.

Please refer to FIGS. 2, 5, and 6. In this embodiment, the total arc length of the first buckle structure 15 is less than the total arc length of the second buckle structure 55. The first buckle structure 15 can be rotated within the second buckle structure 55.

Figure 7:
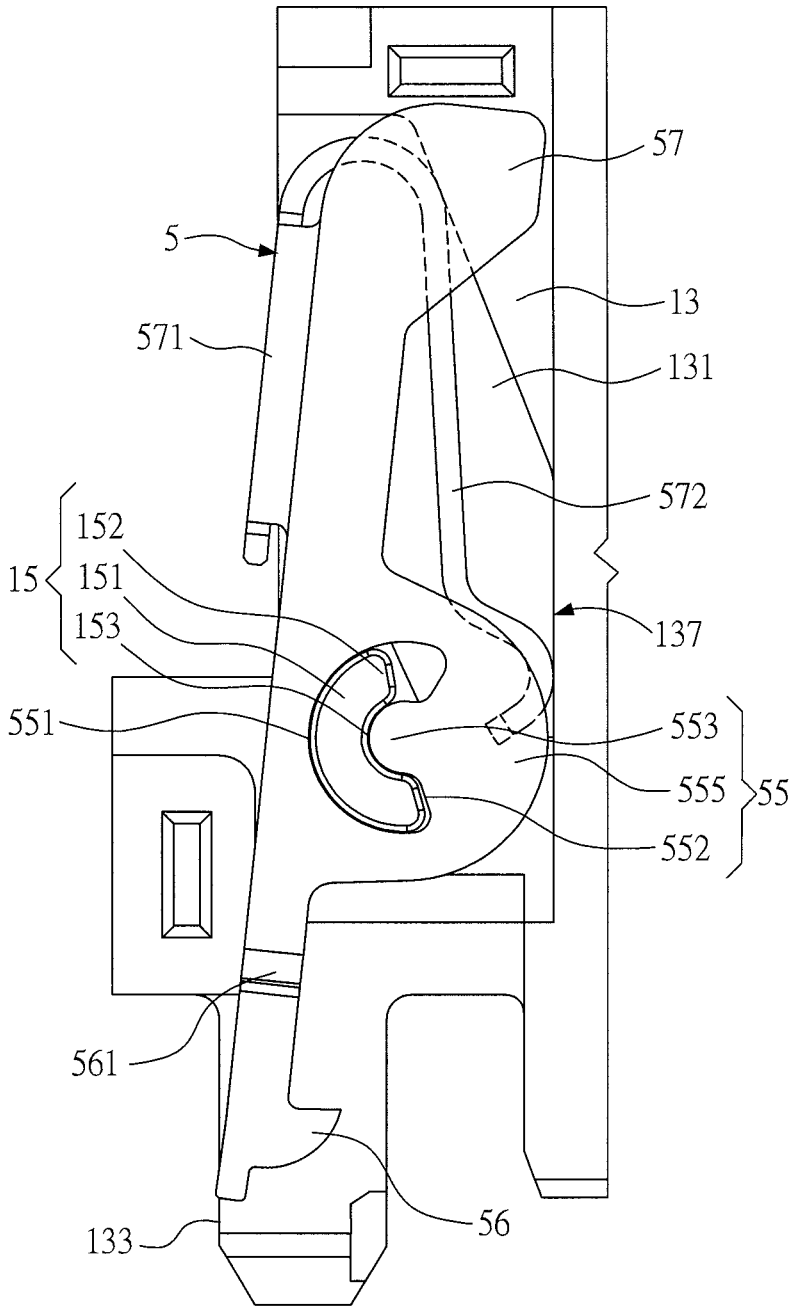
FIG. 7 illustrates a partial top view (2) of the electrical plug connector of the first embodiment.

Please refer to FIGS. 2, 6, 7, and 8. FIG. 7 illustrates a partial top view (2) of the electrical plug connector of the first embodiment. FIG. 8 illustrates an exploded view of an assembly of the electrical plug connector of the first embodiment and an electrical receptacle connector. In this embodiment, when the electrical plug connector 100 is to be detached from the electrical receptacle connector 200, the press portions 57 are pressed, so that each of the press portions 57 is moved toward the interior of the recessed groove 131 of the corresponding side arm 13, and the hook member 5 is rotated by taking the second buckle structure 55 as a rotation center to drive the hook portion 56 to move and to detach from the electrical receptacle connector 200. Hence, the electrical plug connector 100 can be detached from the electrical receptacle connector 200. The electrical receptacle connector 200 has upper and lower metallic shells as well as grounding legs to provide shielding for electromagnetic interferences and radiofrequency interferences.

Please refer to FIGS. 2, 6, 7, and 8. In this embodiment, when the press portions 57 are not pressed by the operator, each of the press portions 57 is pushed outwardly by the resilience force from the elastic arm 572, and the hook member 5 is rotated by taking the second buckle structure 5 as the rotation center to drive the hook portion 56 to move resiliently.

Please refer to FIGS. 2, 6, and 7. The operation between the first buckle structure 15 and the second buckle structure 55 are described as following. The first buckle structure 15 is fixed, and the second buckle structure 55 is rotated. In this embodiment, the second buckle structure 55 is moved to a first position (when the press portion 57 is pressed), the second abutting portion 552 at one of the two ends of the second curve portion 551 is abutted against and stopped by the first abutting portion 152 at one of the two ends of the first curve portion 151, and the edge of the first abutting portion 152 is engaged with the edge of the second abutting portion 552. furthermore, the second buckle structure 55 is moved to a second position (when the press portion 57 is not pressed), the second abutting portion 552 at the other end of the second curve portion 551 is abutted against and stopped by the first abutting portion 152 at the other end of the first curve portion 151, and the edge of the first abutting portion 152 is engaged with the edge of the second abutting portion 552. Hence, when the press portion 57 is pressed by an excessive force, the first abutting portion 152 stops the second abutting portion 552 to prevent the elastic arm 572 from deforming; on the other hand, when the elastic arm 572 is bounced back excessively, the first abutting portion 152 stops the second abutting portion 552 to prevent the hook member 5 from detaching off the recessed groove 131.

Please refer to FIGS. 1, 2, 3, 6, and 8. In this embodiment, an insertion block 133 is extending from an end portion of each of the side arms 13 of the electrical plug connector 100. Each of the hook members 5 of the electrical plug connector 100 comprises a bent portion 561 between the corresponding second buckle structure 55 and the corresponding hook portion 56. The position of each of the hook portions 56 is adjusted by the corresponding bent portion 561 and located on a surface of the corresponding insertion block 133. When the electrical plug connector 100 is mated with the electrical receptacle connector 200, the insertion blocks 133 are inserted into and limited by the recessed portions of the electrical receptacle connector 200, and the hook portions 56 are engaged with the engaging grooves in the recessed portions. Moreover, the shell and the engaging grooves of the electrical receptacle connector 200 may be formed by a unitary member, so that the assembly cost and the defect rate of the product can be reduced.

Figure 4:
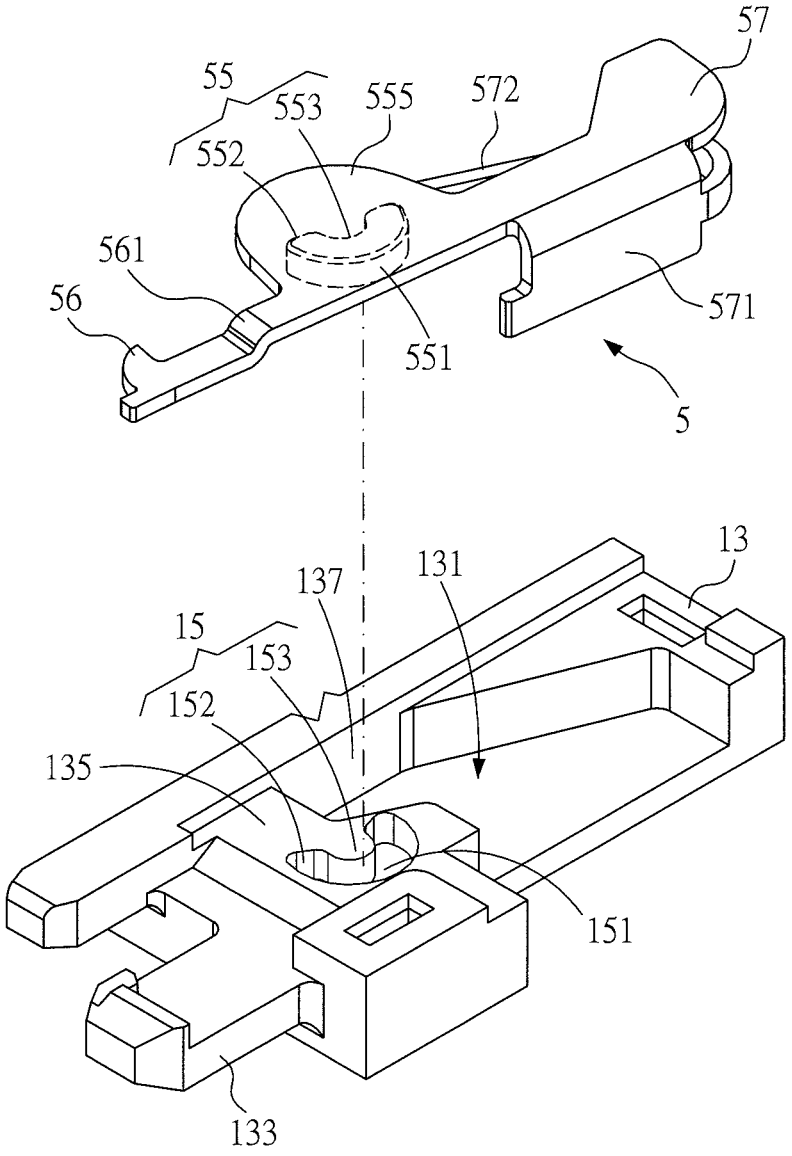
FIG. 4 illustrates a partial exploded view of an electrical plug connector according to a second embodiment of the instant disclosure.

Please refer to FIGS. 3 and 4. FIG. 4 illustrates a partial exploded view of an electrical plug connector according to a second embodiment of the instant disclosure. In the first embodiment, the first buckle structure is a protruding block, and the second buckle structure is a through hole. Conversely, in the second embodiment, the first buckle structure is a through hole, and the second buckle structure is a protruding block.

Please refer to FIG. 4. In the second embodiment, the first buckle structure 15 comprises a first curve portion 151 and two first abutting portions 152 together forming a hole opened on the top surface 135. Namely, the first buckle structure 15 is a through hole. In this embodiment, the first buckle structure 15 forms a crescent-shaped hole (or called C-shaped hole). The first buckle structure 15 comprises the first curve portion 151, the two first abutting portions 152 at two ends of the first curve portion 151, and a first shaft portion 153 at an inner side of the first curve portion 151. The first shaft portion 153 is a protruding portion. From a top view of the first buckle structure 15, the arc length of the first buckle structure 15 is greater than the perimeter of a half circle, but embodiments are not limited thereto. In some embodiments, the arc length of the first buckle structure 15 may be equal to or less than the perimeter of a half circle.

Please refer to FIG. 4. In the second embodiment, each of the hook members 5 comprises a shaft body 555. The shaft body 555 comprises a second curve portion 551 and two second abutting portions 552 protruding outwardly from a bottom portion of the shaft body 555. Namely, the second buckle structure 55 is a protruding block. In this embodiment, the second buckle structure 55 forms a crescent-shaped structure (or called C-shaped structure). The second buckle structure 55 comprises the second curve portion 551, the two abutting portions 552 at two ends of the second curve portion 551, and a second shaft portion 553 at an inner side of the second curve portion 551. The second shaft portion 553 is a recessed portion. The first shaft portion 153 is engaged with the second shaft portion 553 and rotated along the periphery of the second shaft portion 553. From a top view of the second buckle structure 55, the arc length of the second buckle structure 55 is equal to the perimeter of a half circle, but embodiments are not limited thereto. In some embodiments, the arc length of the second buckle structure 55 may be greater than to or less than the perimeter of a half circle.

Please refer to FIG. 4. In the second embodiment, the total arc length of the first buckle structure 15 is less than the total arc length of the second buckle structure 55. The second buckle structure 55 can be rotated within the first buckle structure 15.

As above, according to one or some embodiments of the instant disclosure, the first buckle structure and the second buckle structure are of crescent shapes and mated with each other, and the first and second buckle structure are rotatable relative with each other. When the press portion is pressed by an excessive force, the first/second buckle structure stops the second/first buckle structure to prevent the elastic arm from deforming; on the other hand, when the elastic arm is bounced back excessively, the first/second buckle structure stops the second/first buckle structure to prevent the hook member from detaching off the recessed groove. Furthermore, the first buckle structure and the second buckle structure are of crescent shapes, so that the assembly and the disassembly for the side arm and the hook member can be achieved in a convenient manner.

Furthermore, the mating between the electrical plug connector and the electrical receptacle connector is achieved by an engagement manner, so that the electrical receptacle connector does not detach from the electrical plug connector in an unintentional manner.

Moreover, inspection holes are on the surface of the outer shell, and each of the inspection holes correspond to the corresponding first buckle structure and the corresponding second buckle structure. Therefore, an operator can check the first buckle structures and the second buckle structures from the inspection holes.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

an insulated housing comprising a insertion part which is extending outwardly from a front surface of the insulated housing and has a plurality of terminal grooves formed on an upper surface of the insertion part, and a cable fixing part which is extending outwardly from a rear surface of the insulate housing, wherein two side arms are at two sides of the insulated housing, a recessed groove is formed sunken from a top surface of each of the side arms and a first buckle structure is on the top surface of each of the side arms, the first buckle structure is C-Shaped and comprises a first curve portion and two first abutting portions at two ends of the first curve portion;

a plurality of contact terminals held in the insulated housing, wherein each of the contact terminals comprises a contact portion received and exposed in each of the terminal grooves of the insertion part and a tail portion received in the cable fixing part;

an outer shell covering the insulated housing; and a plurality of hook members at the recessed grooves, wherein each of the hook members comprises a second buckle structure mating with the corresponding first buckle structure, a hook portion is extending from one of two ends of the second buckle structure toward a side portion of the insertion part, and a press portion is extending from the other end of the second buckle structure toward a side portion of the cable fixing part, the second buckle structure is C-Shaped and comprises a second curve portion and two second abutting portions at two ends of the second curve portion.

2. The electrical plug connector according to claim 1, wherein a plurality of inspection holes is on a surface of the outer shell, and each of the inspection holes correspond to the corresponding first buckle structure and the corresponding second buckle structure.

3. The electrical plug connector according to claim 1, wherein the first buckle structure comprises a first shaft portion at an inner side of the first curve portion, the second buckle structure comprises a second shaft at an inner side of the second curve portion, and first shaft portion is connected to the second shaft portion.

4. The electrical plug connector according to claim 1, wherein each of the press portions comprises a side plate extending out of the corresponding side arm.

5. The electrical plug connector according to claim 4, wherein each of the side plates comprises an elastic arm extending toward the corresponding recessed groove and contacting an inner surface of the corresponding recessed groove.

6. The electrical plug connector according to claim 1, wherein the first buckle structure is protruded from the top surface and the first curve portion and the first abutting portions form a C-shaped protruding block.

7. The electrical plug connector according to claim 6, wherein each of the hook members comprises a shaft body, the shaft body comprises the second curve portion and the second abutting portions forming a hole, and the first curve portion is mated with the second curve portion and protruding out of the second curve portion.

8. The electrical plug connector according to claim 7, wherein a total arc length of the first buckle structure is less than a total arc length of the second buckle structure.

9. The electrical plug connector according to claim 1, wherein the first buckle structure is a hole opened on the top surface, and the first curve portion and the first abutting portions form a C-shaped hole.

10. The electrical plug connector according to claim 9, wherein each of the hook members comprises a shaft body, the second curve portion and the second abutting portions are protruding outwardly from a bottom portion of the shaft body.

11. The electrical plug connector according to claim 10, wherein a total arc length of the first buckle structure is greater than a total arc length of the second buckle structure.

* * * * *